United States Patent [19]

Wood, Jr.

[11] 4,217,814

[45] Aug. 19, 1980

[54] DUAL ACTION TRIP AND CONTROL VALVE

[75] Inventor: Richard F. Wood, Jr., Moorestown, N.J.

[73] Assignee: DeLaval Turbine, Inc., Trenton, N.J.

[21] Appl. No.: 894,425

[22] Filed: Apr. 7, 1978

[51] Int. Cl.[2] ..... F15B 11/08; F15B 13/04

[52] U.S. Cl. ..... 91/453; 91/427; 137/625.6; 251/14

[58] Field of Search ..... 91/427, 453, 367, 469; 137/625.6, 625.64, 624.27, 625.2; 251/14

[56] References Cited

U.S. PATENT DOCUMENTS

| | | | |
|---|---|---|---|
| 1,209,796 | 12/1916 | Anderson | 251/14 X |
| 1,275,041 | 8/1918 | Kiesel, Jr. | 251/14 |
| 2,269,835 | 1/1942 | Wallace et al. | 91/469 X |
| 2,610,647 | 9/1952 | Maglott | 137/487 |
| 2,630,829 | 3/1953 | Shafer | 251/14 |
| 3,495,501 | 2/1970 | Kurf-Jensen | 91/440 |
| 3,765,642 | 10/1973 | Nelson | 251/14 |
| 3,939,870 | 2/1976 | Giugliano | 137/625.6 |

*Primary Examiner*—Irwin C. Cohen

*Attorney, Agent, or Firm*—Hopgood, Calimafde, Kalil, Blaustein & Lieberman

[57] ABSTRACT

A dual action trip and control valve is herein described which generally consists of a three way control valve which may be used to control the flow of fluid to and from a power piston. The valve is provided with a trip feature to cause the rapid dumping of the fluid from the power piston cylinder in response to the sensing of an emergency condition or the like.

8 Claims, 1 Drawing Figure

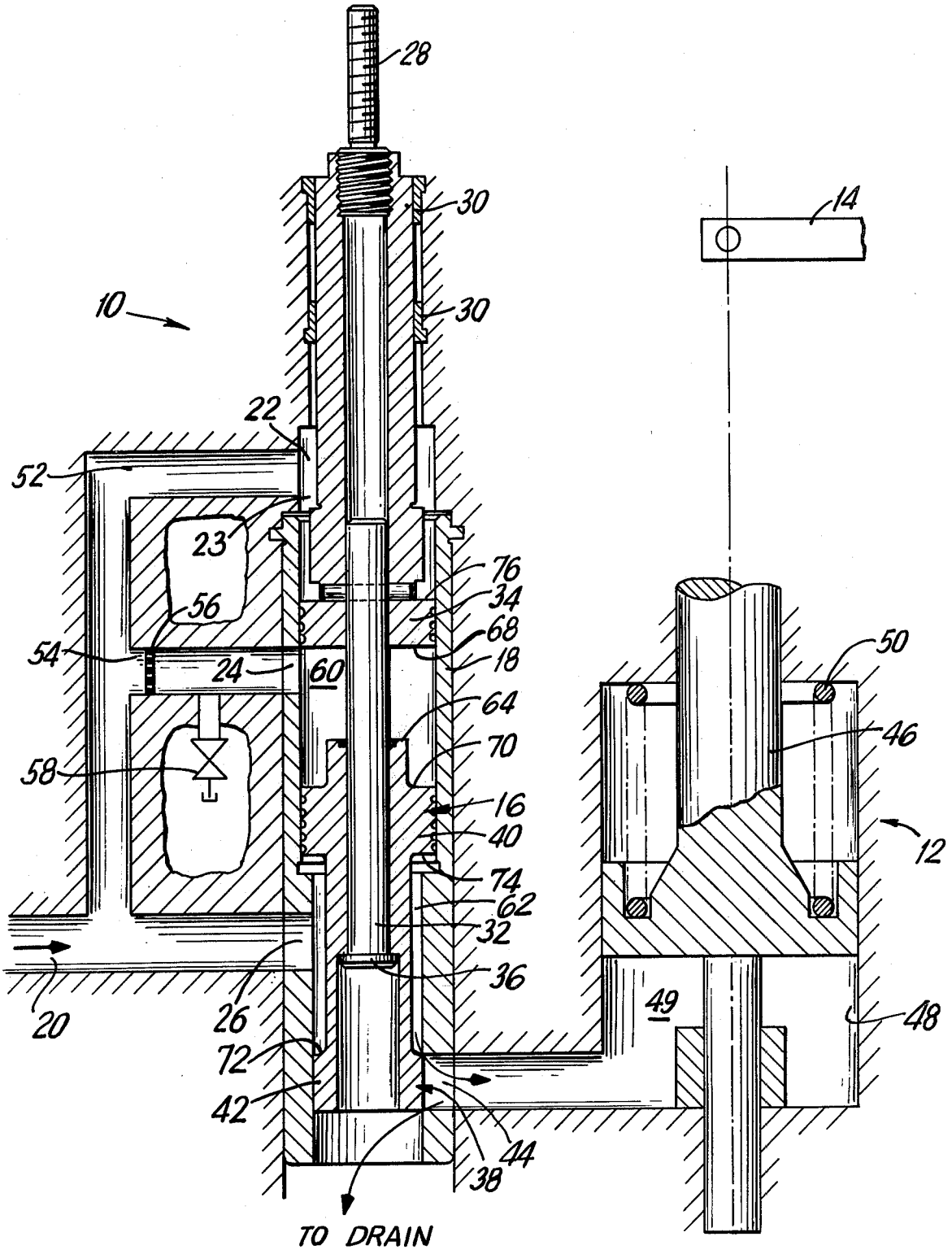
28
30
30
14
10
22
52
23
76
34
56
68
54
24
60
18
64
50
70
46
58
16
40
12
74
62
32
36
20
26
49
48
72
42
44
38
TO DRAIN

DUAL ACTION TRIP AND CONTROL VALVE

BACKGROUND OF THE INVENTION

The present invention relates to control valves generally, and specifically pertains to sliding spool control valves having a trip action which may be used to rapidly shut down a steam turbine, or the like, if an emergency condition develops.

Generally, large turbines are brought up to speed and shut down in a rather gradual manner. However, it sometimes becomes necessary to rapidly shut down such machinery in the event of an emergency condition.

While existing control valves are satisfactory for controlling such large turbine machinery under normal conditions, it would be desirable if a control valve were provided which incorporated a trip feature for very rapidly shutting down a turbine. It would be further desirable, if such a valve arrangement were provided which operated without mechanical springs.

Spool valves are currently known which generally incorporate hydraulic pressures acting on various flanges and surfaces formed thereon to position the spool with respect to critically positioned valve ports. Such spool valves control equipment but none are known to have a springless trip action of the type contemplated herein.

A typical example of an existing spool valve is covered by U.S. Pat. No. 2,610,647 which shows a pilot operated pressure control valve. The action of the valve results in the maintenance of a constant pressure in a fluid line. The device does not incorporate a snap action dump feature which is operative without the use of mechanical springs.

OBJECTS AND SUMMARY OF THE INVENTION

It is therefore an object of the present invention to provide a uniquely simple and reliable dual action trip and control valve which is effective to control turbine machinery, or the like, and which is further operable to rapidly trip and shut down a turbine without the use of mechanical springs in the valve.

The above objective is generally achieved by the provision of a spool valve positioned within a housing and movable to gradually open and close a port communicating the interior of the housing with a power side of power piston. In one position, the spool admits liquid under pressure through the port to the power side of the piston to move the piston in a first direction. In a second position, the spool is operable to trap the liquid on the power side of the piston and thus hold the piston in a desired position. And, when placed in a third position, the spool is operable to drain liquid from the power piston and out through the port so that the power piston may move back to its original position.

The spool comprises a composite element including a spindle and an outer axially slidable spool member which is held in a first position during the normal operation of the control valve. However, when an emergency condition is sensed, a pressure differential is generated across the slidable spool member which, in turn, rapidly slides with respect to both the spindle and the port to cause rapid dumping of the liquid in the power piston cylinder out through the generally fully opened port.

BRIEF DESCRIPTION OF THE DRAWING

While the invention is particularly pointed out and distinctly claimed in a concluding portion of the specification, a preferred embodiment is set forth in the following detailed description which may be best understood when read in conjunction with the accompanying drawing in which:

FIG. 1 is a cut away view of a trip action, control valve according to the present invention.

DETAILED DESCRIPTION OF THE PREFERRED EMBODIMENT

Referring now to the drawing, the preferred embodiment is shown as a spool valve arrangement generally shown as 10, operatively associated with a power piston generally shown as 12 which, in turn, may be connected with a steam turbine control lever 14 or the like.

The spool valve arrangement 10 generally comprises a composite spool member 16 operatively disposed within a cylinder 18.

Various ports are provided in the cylinder 18 and flanges formed on the composite spool member 16 to effect the desired operation of the overall control valve.

Specifically, a source of fluid such as oil or the like is arranged to introduce fluid at a predetermined pressure at inlet 20. The fluid at 20 is transmitted through various ducts to the areas surrounding ports 22, 24 and 26.

The composite spool member 16 generally comprises an upper stem 28 which is mounted for sliding engagement within annular bearings 30. The stem 28 may be formed integrally with a spindle portion 32 presenting an annular flange 34 and a lower stop 36. The overall spool member 16 further includes a slidable spool element 38 which is longitudinally slidable between the flange 34 and the lower stop 36. The slidable spool element 38, in turn, presents an upper flange portion 40 and a lower flange portion 42. The flange portion 34 of the spindle and the flange portions 40 and 42 of the slidable spool element are of such an outside diameter as to sealingly engage the inside surface of the cylinder 18.

A power piston port 44 is formed in the cylinder 18 and positioned to receive fluid from the cylinder 18 in response to the positioning of flange 42 of the slidable spool element 38. The port 44 is further arranged to communicate the liquid in cylinder 18 with the power side of the power piston 46 operatively disposed within a power piston cylinder 48. The power piston 46 is urged by a spring bias 50 or equivalent means in a direction which decreases the volume to the space 49 for receiving fluid on the power side thereof.

The power piston 46 is operable to increase turbine speed by moving the lever 14 upwardly in response to the admission of fluid through port 44 into the space 49. Conversely, the power piston 46 is operable to decrease turbine speed or shut down a turbine in response to the draining of fluid from the space 49.

Normal Operation

In normal operation, the composite spool member 16 is held (by an arrangement to be described hereinafter) against the stop member 36 so that the spindle 32 and slidable spool element 38 operate as a unitary spool. When this spool arrangement is moved by applying an outside downwardly force to the stem 28, the flange 42 gradually clears a portion of the port 44 and admits pressurized fluid to the space 49 on the power side of the piston 46. As a result, the power piston 46 is moved against the bias of spring 50 to pivot the level 14 in a direction which is operable to increase turbine speed.

When the turbine speed is at a desired level, the stem 28 is moved upwardly so that the flange 42 completely covers the port 44 as shown in the drawing so as to trap the fluid within the space 49 to maintain the position of the level 14 against the spring bias of element 50.

When it is desired to slow down the turbine, the stem 28 is again moved upwardly so that the flange 42 opens a portion of the port 44 to drain the fluid within the space 49. As the fluid drains from the space 49, the power piston 46 moves downwardly under the influence of spring bias element 50 to move the lever 14 downwardly which, in turn, slows down or shuts off the steam to the turbines controlled by the overall valve arrangement.

The Preferred Configuration Of The Overall Spool Member

As previously mentioned, the overall spool member comprises a composite including a spindle 32 and a slidable spool element 38 which is normally held against the stop 36 of the spindle 32 in the following manner.

The supply fluid entering at 20 is directed by duct 54 to the space 60 through an orifice 56. When there is no flow through the orifice 56, as is the normal condition, the pressure in the space 60 equals the pressure at both the supply point 20 and the space 62.

The force on the slidable spool element 38 is a function of (1) the downward force generated by the pressure within the space 60 acting on the areas 70 and 64; plus the force generated by the pressure within the space 62 acting on the area 72 of the flange 42 of the slidable spool element 38; and (2) the upward force generated by the pressure within the space 62 acting on area 74 of the flange 40 of the slidable spool element 38. The surfaces (70 and 64) and 72 comprise a greater area than the area 74 of the flange 40 of the slidable spool element 38 so that, when the pressures within the spaces 60 and 62 are equal, as in the normal condition, the net force on the slidable spool element 38 is downwardly against the stop 36.

The source of control fluid provided at 20 not only communicates with the duct 26 but further communicates with port 22 through duct 52 and with port 24 through duct 54. Therefore, the pressures within the chambers 23, 60 and 62 are all equal. No net force is exerted on the stem 28 by these pressures acting on any areas. The upward force exerted by the pressure within space 60 on area 68 is exactly equaled by the downward force of the pressure within space 60 acting on areas 64 and 70 which together equal area 68. This downward force is transmitted through slidable spool element 38 to lower stop 36, and then to stem 28 by way of spindle 32. Areas 76 and 72 together equal area 74, so in the same way, the upward force caused by the pressue within space 62 acting on area 74 is exactly equaled by the downward force caused by the pressure within space 62 acting on area 72, together with the force caused by the pressure within space 23 acting on area 76.

The Trip Action

When and if it becomes necessary to rapidly shut down the associated turbine machinery, the following features of the arrangement come into operation.

The orifice 56 is operatively disposed within the duct 54 which is further provided with a valve element 58 for producing a fluid flow within the duct 54. Of course, the combination of the valve 58 and the orifice 56 is primarily a pressure reducing feature for which other pressure reducing elements may be substituted or, which may be replaced by a direct communication conduit to an oil lubricant line in which it is necessary to maintain a certain high pressure and with respect to which it is necessary to instanteously detect any unexpected drop in pressure.

In operation, when the pressure in duct 54 is reduced by the manual opening of the valve 58, or any similar reduction in pressure produced as previously discussed, the pressure within the space 60 defined within the cylinder 18 between the flange 34 of the spindle 32 and the flange 40 of the slidable spool element 38 is likewise reduced. As a result, the pressure in the space 62 between the flange 40 and the flange 42 becomes greater than that within the space 60 and rapidly forces the spool element 38 upwardly, as described hereinafter, until the upper radial surface 64 of the slidable spool element 38 engages the surface 68 of the flange 34 on the spindle 32.

This rapid movement of the outer spool element 38 to the extreme upper position is operable to move the flange 42 thereto to a position completely clear of the port 44. As a result, the fluid within the space 49 rapidly dumps to drain and the power piston 46 rapidly moves downwardly so as to shut off the steam to the turbine machinery.

The rapid upward motion of the sliding spool element 38, previously described, is a result of the unbalance of forces on said spool element, as follows: The force on the spool element is a result of an upward component and a downward component, as previously described. When the pressure within space 60 is reduced below a certain level the net force on the spool element is upwards.

While what has been described herein is a preferred embodiment of the invention, it is, of course, to be understood that various modifications and changes may be made therein without departing from the invention. It is therefore intended to cover in the following claims all such modifications and changes as may fall within the true spirit and scope of the present invention.

What is claimed is:

1. A control and safety trip valve in combination with a machinery control element and a source of pressurized fluid comprising:

a valve housing;

a valve spool movably mounted within said valve housing, said valve spool being movable in first and second directions in said housing, said valve spool including a pressure responsive spool portion and a flange portion having opposed pressure responsive faces, said pressure responsive spool portion and one of said opposed pressure responsive faces defining a space therebetween, said flange portion being mounted on said spool portion for engaging a stop means on said spool portion;

means externally operable for moving said valve spool in said first and second directions within said valve housing;

first port means communicating said source of pressurized fluid to said valve housing to the space between said valve spool portion and said flange portion, said pressurized fluid operatively coupling said valve spool portion and said flange portion by engagement of said flange portion with said stop means to permit said flange portion and said valve spool portion to move as a unit in said first and second directions;

a cylinder housing a power piston operably coupled to said machinery element for actuating same, said power piston being biased by means in a first direction;

second port means communicating said source of pressurized fluid to said valve housing adjacent to said flange portion and acting on the other of said opposed pressure responsive faces;

third port means in said valve housing adjacent to said flange portion permitting communication of said pressurized fluid from said valve housing to said cylinder;

drain means for receiving said pressurized fluid;

said flange portion when moved in said first direction by said valve spool operatively coupling said second port means to said third port means to permit fluid flow to said cylinder to thereby move said power piston in a direction opposed to said bias;

said flange portion when moved in said second direction by said valve spool connecting said drain means to said power piston to thereby move said piston in the first direction in response to said bias;

means coupled to said first port means to decrease the pressure in said valve housing in the space between said valve spool and said flange portion to operatively de-couple said valve spool from said flange portion and to rapidly move said flange portion in said second direction responsive to pressure acting on said other opposed pressure responsive face to rapidly dump said fluid from said power piston to said drain means to permit said piston to move rapidly in said first direction in response.

2. A valve according to claim 1 wherein said flange portion is movably mounted to said valve spool portion by means of a spindle on which said flange portion is slidably disposed, said spindle including a stop defining said stop means in an end remote from said valve spool portion, the pressurized fluid emanating from said first port means biasing said flange portion against said stop, when said pressure is reduced by said means coupled to said first port, said flange portion moving away from said stop.

3. A valve according to claim 1 wherein said flange portion includes an annular narrowed portion to permit fluid communication between said second port means and said third port means.

4. A valve according to claim 1 in which said externally operable means to move said valve spool comprise a member extending from said valve spool and an opening in said housing through which said member extends, said member being threaded to adjust the position of said valve spool within said valve housing.

5. A valve according to claim 1 in which said drain means comprise a portion of said valve housing.

6. A valve according to claim 1, further including fourth port means communicating said source of pressurized fluid to said valve housing adjacent to said valve spool so that the net axial force between said valve spool, said housing and said flange portion is zero.

7. A valve according to claim 6, in which said valve spool includes an annular narrowed portion adjacent to said fourth port means.

8. A valve according to claim 1, in which said means coupled to said first port means for decreasing the pressure between said valve spool portion and said flange portion comprises valve means.

* * * * *